US007600497B2

(12) United States Patent
Vanderpoel

(10) Patent No.: US 7,600,497 B2
(45) Date of Patent: Oct. 13, 2009

(54) FINGER FOLLOWER LOST MOTION VALVE ACTUATION SYSTEM WITH LOCATING LINK

(75) Inventor: Richard E. Vanderpoel, Bloomfield, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 420 days.

(21) Appl. No.: 11/524,292

(22) Filed: Sep. 21, 2006

(65) Prior Publication Data

US 2008/0072853 A1 Mar. 27, 2008

(51) Int. Cl.
*F01L 1/18* (2006.01)

(52) U.S. Cl. ..... 123/90.39; 123/90.16; 123/90.44

(58) Field of Classification Search ..... 123/90.16, 123/90.44, 90.39
See application file for complete search history.

(56) References Cited

U.S. PATENT DOCUMENTS 5,022,360 A 6/1991 Cholewczynski
5,485,815 A 1/1996 Shida
6,085,705 A * 7/2000 Vorih ..... 123/90.12
6,340,010 B1 1/2002 Hara et al.
6,349,688 B1 * 2/2002 Gracyalny et al. ..... 123/90.39
6,971,355 B2 12/2005 Roth

* cited by examiner

*Primary Examiner*—Zelalem Eshete
(74) *Attorney, Agent, or Firm*—David R. Yohannan, Esq.; Kelley Drye & Warren LLP

(57) ABSTRACT

An engine valve actuation system for an internal combustion engine is disclosed. The valve actuation system may include a longitudinally extending link member pivotally attached to an engine member. A longitudinally extending finger follower may be pivotally attached to the link member. The finger follower may include first and second contact surfaces spaced longitudinally from each other. A lost motion piston may contact the first contact surface of the finger follower and an engine valve assembly may contact the second contact surface of the finger follower. A means for receiving valve actuation motion, such as a cam follower, may be incorporated into the finger follower. A valve seating device may contact a third contact surface located on the link member, and a biasing spring may contact a fourth contact surface on the finger follower.

19 Claims, 3 Drawing Sheets

FINGER FOLLOWER LOST MOTION VALVE ACTUATION SYSTEM WITH LOCATING LINK

All references cited in this specification, and their references, are incorporated by reference herein where appropriate for teachings of additional or alternative details, features, and/or technical background.

FIELD OF INVENTION

The present invention generally relates to lost motion engine valve actuation systems for internal combustion engines. Lost motion valve actuation technology can be used to advantageously control the engine's operating characteristics.

BACKGROUND OF THE INVENTION

Valve actuation in an internal combustion engine is required in order for the engine to operate. During the intake portion of the cycle, one or more intake valves may be opened to admit air or fuel and air into a cylinder for combustion. Subsequently, during the exhaust portion of the cycle, one or more exhaust valves may be opened to allow combustion gas to escape from the cylinder. Intake, exhaust, and/or auxiliary valves also may be opened at various times to provide engine braking and to recirculate gases from the intake and exhaust manifolds to engine cylinders.

Engine valve actuation may be used to produce engine braking and exhaust gas recirculation (EGR) when the engine is not being used to produce power. During engine braking, the exhaust valves may be selectively opened to temporarily convert the engine into an air compressor. In doing so, the engine develops retarding torque to help slow the vehicle down. This can provide the operator with increased control over the vehicle and substantially reduce wear on the service brakes of the vehicle.

In many internal combustion engines, the intake and exhaust valves may be opened and closed by fixed profile cams, and more specifically by one or more fixed lobes that are an integral part of each of the cams. Benefits such as increased performance, improved fuel economy, lower emissions, and better vehicle drivability may be obtained if the intake and exhaust valve timing and lift can be varied. The use of fixed profile cams, directly opening and closing the valves, however, can make it impractical to adjust the valve timings and lift.

One proposed method of adjusting valve timing and lift, given a fixed cam profile, has been to provide a "lost motion" device in the valve train linkage between the valve and the cam. Lost motion is a technique for modifying the valve motion proscribed by a cam profile with a variable length mechanical, hydraulic, or other linkage assembly. In a lost motion system, a cam lobe may provide the "maximum" (longest dwell and greatest lift) motion needed over a full range of engine operating conditions. A variable length system may then be included in the valve train linkage used to actuate the valve to be opened, to subtract or lose part or all of the motion imparted by the cam to the valve.

This variable length system (or lost motion system) may, when expanded fully, transmit all of the cam motion to the valve, and when contracted fully, transmit none or a reduced amount of the cam motion to the valve. Lost motion systems which are used to provide variable valve actuation on an engine cycle-by-cycle basis must be sufficiently fast to allow the variable length link to vary within the duration of the cam rotational period. An example of such a system and method is provided in Hu, U.S. Pat. Nos. 5,537,976 and 5,680,841, which are assigned to the same assignee as the present application.

Engine benefits from lost motion variable valve actuation systems can be achieved by creating complex cam profiles with extra lobes or bumps to provide auxiliary valve lifts in addition to the conventional main intake and exhaust events. For example, an intake cam profile may include an additional lobe for exhaust gas recirculation (EGR) prior to the main intake lobe, and/or an exhaust cam profile may include an additional lobe for EGR after the main exhaust lobe. Other auxiliary lobes for any number of engine valve events, such as cylinder charging and/or compression release braking may also be included on the cams. The lost motion variable valve actuation system may be used to selectively cancel or activate any or all combinations of valve lifts possible from the assortment of lobes provided on the intake and exhaust cams. As a result, significant improvements may be made to both power and engine braking operation of the engine.

In one lost motion valve activation system, the displacement applied to the valve is a combination of displacements created by a control piston and a valve seating device as well as the cam. One possible implementation of lost motion valve actuation employs a finger follower assembly to combine these displacements and apply the result to the valve. Preferred finger followers may have low mass and provide low inertia. It is therefore an advantage of some, but not necessarily all, embodiments of the present invention to provide the foregoing capabilities. Additional advantages of various embodiments of the invention are set forth, in part, in the description that follows and, in part, will be apparent to one of ordinary skill in the art from the description and/or from the practice of the invention.

SUMMARY OF INVENTION

Responsive to the foregoing challenges, Applicant has developed an innovative engine valve actuation system for an internal combustion engine comprising: a link member pivotally attached to an engine member; a longitudinally extending finger follower pivotally attached to the link member, said finger follower having first and second contact surfaces spaced longitudinally from each other; a lost motion piston contacting the first contact surface of the finger follower; an engine valve assembly contacting the second contact surface of the finger follower; and a means for receiving valve actuation motion incorporated into the finger follower.

Applicant has further developed an innovative engine valve actuation system for an internal combustion engine comprising: a link member pivotally attached to an engine member; a longitudinally extending finger follower pivotally attached to the link member, said finger follower having first and second contact surfaces spaced longitudinally from each other; a lost motion piston contacting the first contact surface of the finger follower; an engine valve assembly contacting the second contact surface of the finger follower; a means for receiving valve actuation motion incorporated into the finger follower; a third contact surface located on said link member; and a valve seating device contacting the third contact surface.

Applicant has still further developed an innovative engine valve actuation system for an internal combustion engine comprising: a link member pivotally attached to an engine member; a longitudinally extending finger follower pivotally attached to the link member, said finger follower having first and second contact surfaces spaced longitudinally from each other; a lost motion piston contacting the first contact surface of the finger follower; an engine valve assembly contacting the second contact surface of the finger follower; a means for receiving valve actuation motion incorporated into the finger follower; a third contact surface located on said link member; a valve seating device contacting the third contact surface; a fourth contact surface located on the finger follower; and a means for biasing the finger follower contacting the fourth contact surface.

It is to be understood that both the foregoing general description and the following detailed description are exemplary and explanatory only, and are not restrictive of the invention as claimed.

BRIEF DESCRIPTION OF DRAWINGS

Various of the above mentioned and further features and advantages may be better understood from this description of embodiments thereof, including the attached drawing figures wherein like reference characters refer to like elements.

DETAILED DESCRIPTION OF EMBODIMENTS OF THE INVENTION

One approach to lost motion valve actuation may employ a mechanical linkage including a finger follower disposed between the cam and the valve being controlled. Such mechanical linkage may be designed to permit selective variation of the engine valve actuation on a dynamic basis. The valve actuation provided by a cam and finger follower combination may be a function of, without limitation: (1) the sizes and shapes of the cam lobe(s) that act directly or indirectly on the finger follower; (2) the position and control of a lost motion piston which supports either a free end of the finger follower or a member directly or indirectly connected to the finger follower; and (3) the position and control of a valve seating device which may be employed to manage valve seating.

Figure 1:
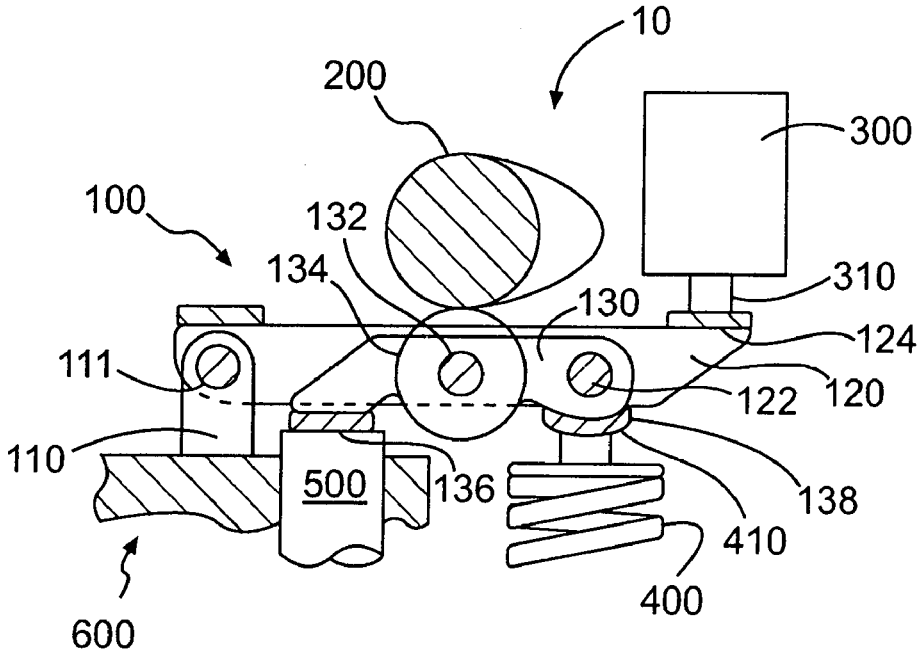
FIG. 1 is a schematic side view in partial cross-section of a lost motion valve actuation system constructed in accordance with a first embodiment of the present invention.

FIG. 1 is a schematic illustration of a first embodiment of the present invention comprising a variable valve actuation system 10 operatively connected to an internal combustion engine valve assembly 400. The VVA system 10 may include a linkage assembly 100, a cam or other means for imparting motion 200, a valve seating device 300, and a lost motion piston 500. The VVA system 10 may be connected to, in contact with, and partially housed in an engine member 600, such as an engine head.

The linkage assembly 100 may include a finger follower support member 110, a link 120, and a finger follower 130. The support member 110 may be connected to the engine member 600 and pivotally connected to a first end of the link 120 by a hinge pin 111. A second end of the link 120 may include a convex hardened surface 124 adapted to contact the valve seating device 300 through the seating pin 310.

Figure 2:
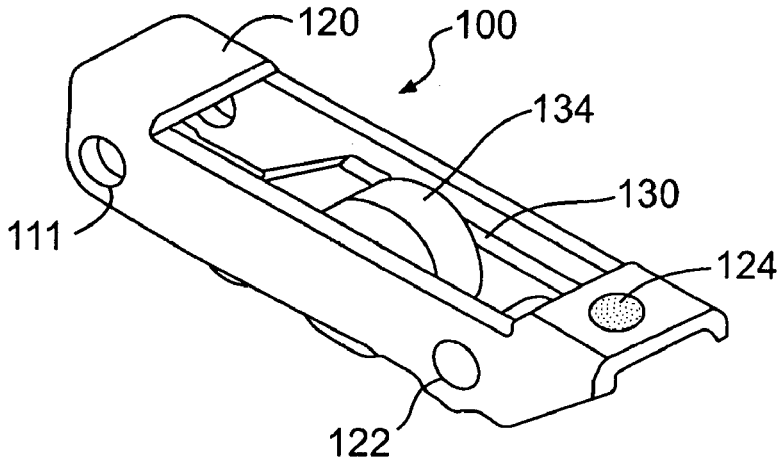
FIG. 2 is an isometric view of the first embodiment of the present invention illustrated in FIG. 1.

With reference to FIGS. 1 and 2, the link 120 may include two longitudinally extending arms which define an internal open space therebetween for receipt of the finger follower 130. A first end of the finger follower 130 may be pivotally connected to a second end of the link 120 by a pivot pin 122. The finger follower 130 may include a cam follower 134 connect to it by a roller pin 132. A free end of the finger follower 130 may include a hardened surface 136 that contacts an upper surface of the lost motion piston 500. The hardened surface 136 may be convex to allow it to pivot on the upper surface of the lost motion piston. The pivot pin end of the finger follower 130 may also include a convex hardened surface 138 that contacts the upper end of a valve stem 410 or alternatively a valve bridge. An engine valve spring 410 may bias the valve stem 410 towards the surface 138 of the finger follower.

With continued reference to FIG. 1, when the cam 200 rotates, the one or more lobes on the cam may act against the cam follower 134. If the lost motion piston 500 is hydraulically locked into position, the free end of the finger follower 130 at hardened surface 136 may be prevented from being pushed downward. As a result, the finger follower may pivot about its free end, and the end of the finger follower with the hardened surface 138 will be displaced downward to actuate the engine valve 410. Because the link 120 is connected to the finger follower 130 by the pivot pin 122, the link may rotate downward about the hinge pin 111. This may cause the hardened surfaces 136 and 138 to slide slightly along the surface of the lost motion piston 500 and the upper end of the valve 410, respectively. At the same time, the seating pin 310 may follow the free end of the link 120 downward a predetermined distance. If the lost motion piston is maintained in a static position for the duration of the time that the cam 200 lobe acts on the cam follower 134, the ramps that form the beginning and the end of the cam lobe may seat the engine valve in cooperation with the valve seating device 300.

The valve actuation provided by the one or more lobes of the cam 200 may be modified by selectively changing the position of the lost motion piston 500 while the cam lobe(s) are acting on the cam follower 134. Selective change of the position of the lost motion piston 500 may be accomplished by releasing hydraulic fluid from a chamber (not shown) below the lost motion piston. If the valve actuation provided by the one or more lobes of the cam 200 is truncated by releasing the hydraulic lock on the lost motion piston 500, the valve spring 400 and/or pressurized gas in the engine cylinder may cause the valve 410 to return (travel upwards) rapidly towards its seat. If this occurs, the valve seating device 300 may prevent the engine valve 410 from seating too quickly by opposing its upward motion through the seating pin 310.

If the lost motion piston 500 is not hydraulically locked in place when the cam lobe begins to act on the cam follower 134, the free end of the finger follower 130 at hardened surface 136 may be pushed downward. As a result, the finger follower 130 may pivot about the end connected to the link 120 by the pivot pin 122 and the link 120 may remain relatively stationary so that the engine valve 410 is not actuated. By selectively controlling the times that the lost motion piston 500 is hydraulically locked into position, and the position (height) of the lost motion piston relative to the engine member 600, lost motion and/or variable valve actuation may be provided using the system 10.

Figure 3:
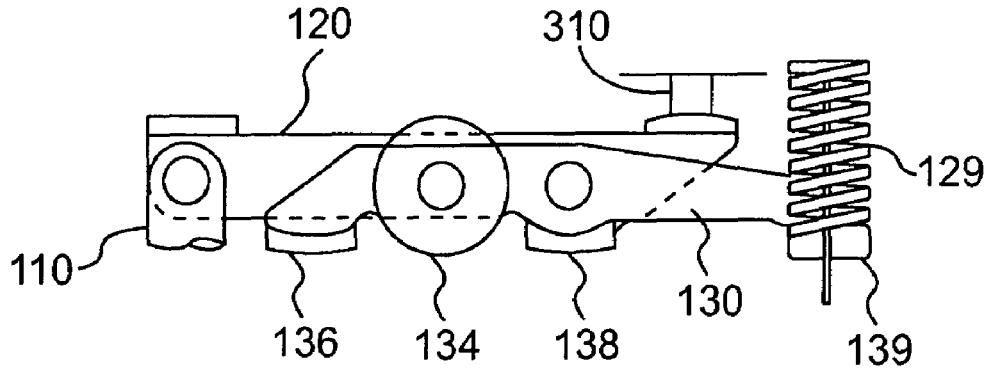
FIG. 3 is a schematic side view of a lost motion valve actuation system constructed in accordance with a second embodiment of the present invention.

With reference to FIG. 3, in an alternative embodiment of the present invention, the finger follower 130 may include an end distal from the first contact surface 136 which extends past the end of the link 120. The finger follower 130 may include a fourth contact surface 139 at the end distal from the first contact surface. A spring 129 may contact the fourth contact surface and bias the finger follower 130 towards the engine valve assembly that contacts the second contact surface 138.

Figure 4:
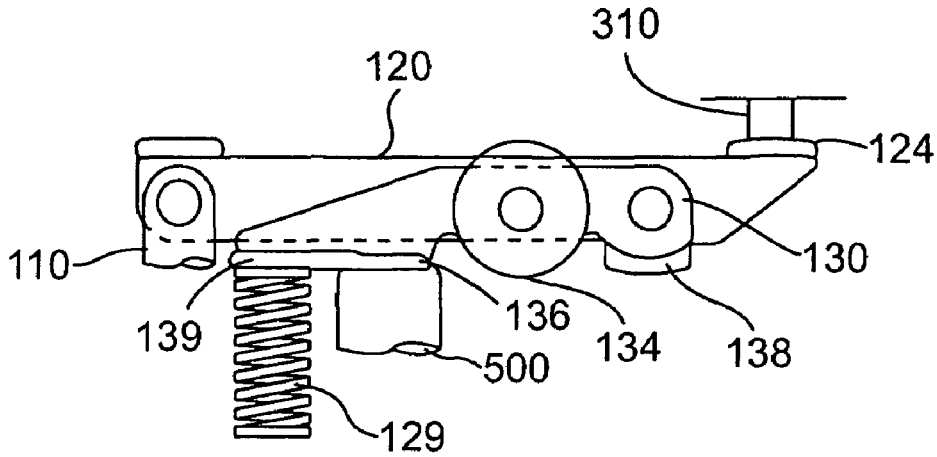
FIG. 4 is a schematic side view of a lost motion valve actuation system constructed in accordance with a third embodiment of the present invention.

With reference to FIG. 4, in another alternative embodiment of the present invention, the finger follower 130 may include an end proximal to the first contact surface 136 located within the longitudinally extending arms of the link 120 with the fourth contact surface 139. A spring 129 may contact the fourth contact surface 139 and bias the finger follower towards the engine valve assembly that contacts the second contact surface 138. The fourth contact surface 139 and the first contact surface 136 may be adjacent to each other as shown in the figure. The fourth contact surface 139 may also include features to assist in retaining the spring 129 in position relative to the finger follower.

Figure 5:
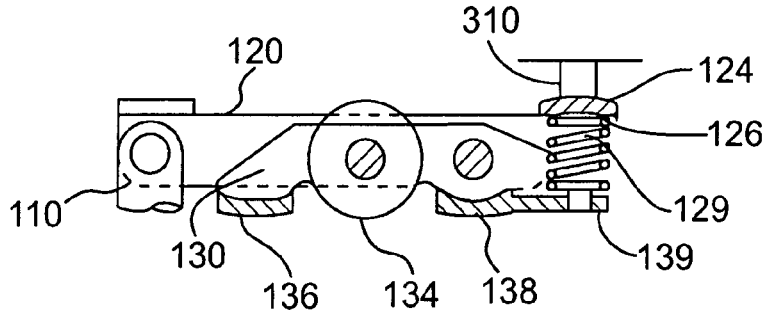
FIG. 5 is a schematic side view of a lost motion valve actuation system constructed in accordance with a fourth embodiment of the present invention.

With reference to FIG. 5, in still another alternative embodiment of the present invention, the finger follower 130 may include a fourth contact surface 139 at the end distal from the first contact surface 136, and the link 120 may include a fifth contact surface 126 located above the fourth contact surface. A spring 129 may be disposed between and contact the fourth 139 and fifth 126 contact surfaces and thereby bias the finger follower 130 towards the engine valve assembly that contacts the second contact surface 138. The fourth contact surface 139 and the second contact surface 138 may be adjacent to each other as shown in the figure. The fourth and fifth contact surfaces may also include features to assist in retaining the spring 129 between them.

Figure 6:
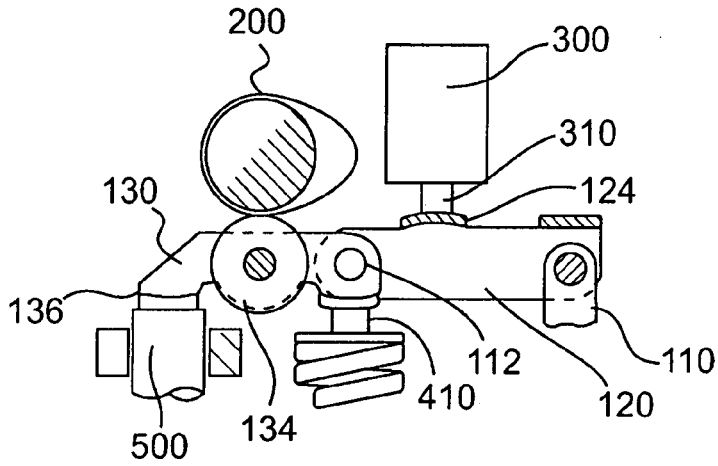
FIG. 6 is a schematic side view in partial cross-section of a lost motion valve actuation system constructed in accordance with a fifth embodiment of the invention.

Another embodiment of the present invention is shown in FIG. 6 in which a substantial portion of the finger follower 130 may not be disposed between the arms of the link 120. In this embodiment, the link 120 and the finger follower 130 may be disposed laterally adjacent to each other.

Figure 7A:
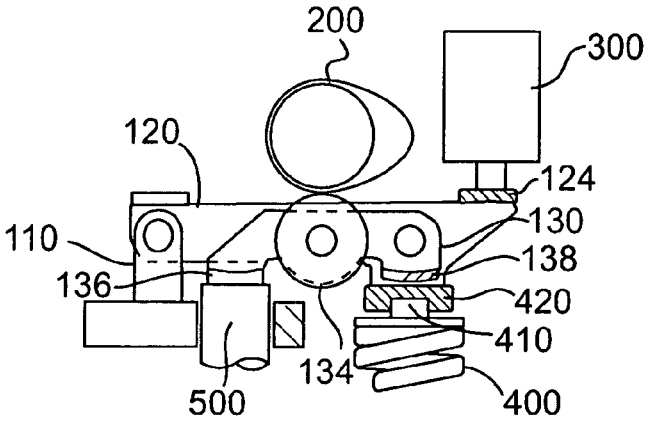
FIGS. 7*a-b* are schematic views in partial cross-section of a lost motion valve actuation system constructed in accordance with a sixth embodiment of the present invention.
Figure 7B:
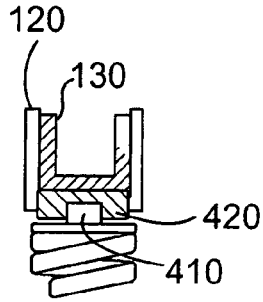

In a further embodiment of the present invention, FIGS. 7*a* and 7*b* illustrate an embodiment for maintaining the link 120 and finger follower 130 aligned with valve stem included in the valve assembly 410. In this embodiment, the valve assembly 410 may include a cap 420 disposed between the top of valve stem and the second contact surface 138. The contact surface of finger follower 120 bears on top of cap 420. Link 120 may have projections on each side that guide the outer diameter of cap 420, keeping the finger follower centered over the cap.

STATEMENT REGARDING PREFERRED EMBODIMENTS

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed:

1. An engine valve actuation system for an internal combustion engine comprising:

a link member pivotally attached to an engine member;

a longitudinally extending finger follower pivotally attached to the link member, said finger follower having first and second contact surfaces spaced longitudinally from each other;

a lost motion piston contacting the first contact surface of the finger follower;

an engine valve assembly contacting the second contact surface of the finger follower; and a means for receiving valve actuation motion incorporated into the finger follower, wherein the link comprises two longitudinally extending arms and at least a portion of said finger follower is disposed between said arms.

2. The engine valve actuation system of claim 1 further comprising:

a third contact surface located on said link member; and a valve seating device contacting the third contact surface.

3. The engine valve actuation system of claim 2 further comprising:

a fourth contact surface located on the finger follower; and a means for biasing the finger follower contacting the fourth contact surface.

4. The engine valve actuation system of claim 2 further comprising:

a fourth contact surface on the finger follower spaced longitudinally from the first and second contact surfaces and distal from said first contact surface; and a means for biasing the finger follower contacting the fourth contact surface.

5. The engine valve actuation system of claim 4 further comprising:

a fifth contact surface located on the link, wherein the means for biasing is disposed between, and in contact with, the fourth and fifth contact surfaces.

6. The engine valve actuation system of claim 5 wherein the second and fourth contact surfaces are adjacent to each other.

7. The engine valve activation system of claim 2 further comprising:

a fourth contact surface on the finger follower spaced longitudinally from the first and second contact surfaces and distal from said second contact surface; and a means for biasing the finger follower in contact with the fourth contact surface.

8. The engine valve actuation system of claim 7 wherein the first and fourth contact surfaces are adjacent to each other.

9. The engine valve actuation system of claim 1 further comprising:

a third contact surface located on the finger follower; and a means for biasing the finger follower contacting the third contact surface.

10. The engine valve activation system of claim 1 further comprising:

a third contact surface on the finger follower spaced longitudinally from the first and second contact surfaces and distal from said first contact surface; and a means for biasing the finger follower contacting the third contact surface.

11. The engine valve actuation system of claim 10 further comprising:

a fourth contact surface located on the link, wherein the means for biasing is disposed between, and in contact with, the third and fourth contact surfaces.

12. The engine valve actuation system of claim 11 wherein the second and third contact surfaces are adjacent to each other.

13. The engine valve activation system of claim 1 further comprising:

a third contact surface on the finger follower spaced longitudinally from the first and second contact surfaces and distal from said second contact surface; and a means for biasing the finger follower contacting the third contact surface.

14. The engine valve actuation system of claim 13 wherein the first and third contact surfaces are adjacent to each other.

15. The engine valve actuation system of claim 1 wherein the point at which the link member is pivotally attached to the engine member is closer to the first contact surface than to the second contact surface.

16. The engine valve actuation system of claim 1 wherein the point at which the link member is pivotally attached to the engine member is closer to the second contact surface than to the first contact surface.

17. The engine valve actuation system of claim 2 wherein the point at which the link member is pivotally attached to the engine member is closer to the second contact surface than to the first contact surface.

18. The engine valve actuation system of claim 1 wherein said engine valve assembly includes a valve stem cap vertically disposed between the engine valve and said second contact surface, and laterally disposed between the longitudinally extending arms of the link.

19. The engine valve actuation system of claim 1 wherein said engine valve assembly includes a valve stem cap disposed between the engine valve and said second contact surface.

* * * * *